US009030376B2

(12) United States Patent
Kim et al.

(10) Patent No.: US 9,030,376 B2
(45) Date of Patent: May 12, 2015

(54) DISPLAY DEVICE TO DRIVE A PLURALITY OF DISPLAY MODULES FOR DIVIDING DATA SIGNALS

(71) Applicant: LG Display Co., Ltd., Seoul (KR)

(72) Inventors: Seong Gyun Kim, Gunpo-si (KR); Hee Jung Hong, Seoul (KR); Nam Yong Gong, Anyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/446,592

(22) Filed: Jul. 30, 2014

(65) Prior Publication Data

US 2014/0340386 A1 Nov. 20, 2014

Related U.S. Application Data

(63) Continuation of application No. 12/003,775, filed on Dec. 31, 2007, now Pat. No. 8,810,477.

(30) Foreign Application Priority Data

Apr. 12, 2007 (KR) ..... 10-2007-0035843

(51) Int. Cl.
*G09G 5/00* (2006.01)
*G09G 3/36* (2006.01)

(52) U.S. Cl.
CPC ..... *G09G 3/3688* (2013.01); *G09G 3/3611* (2013.01); *G09G 3/3666* (2013.01); *G09G 2360/122* (2013.01); *G09G 2360/18* (2013.01); *G09G 2300/026* (2013.01); *G09G 2300/08* (2013.01); *G09G 2310/08* (2013.01); *G09G 2360/12* (2013.01)

(58) Field of Classification Search
CPC ..... G09G 3/3611; G09G 3/3666; G09G 2360/18; G09G 2360/122
USPC ..... 345/1.1–1.3, 4, 5
See application file for complete search history.

(56) References Cited

U.S. PATENT DOCUMENTS

| | | | | |
|---|---|---|---|---|
| 4,907,095 | A * | 3/1990 | Komura et al. | 358/451 |
| 5,021,770 | A * | 6/1991 | Aisaka et al. | 345/156 |
| 5,784,035 | A | 7/1998 | Hagiwara et al. | |
| 5,929,832 | A * | 7/1999 | Furukawa et al. | 345/98 |
| 6,118,413 | A | 9/2000 | Bril et al. | |
| 6,333,750 | B1 | 12/2001 | Odryna et al. | |
| 6,414,649 | B2 * | 7/2002 | Tonosaki et al. | 345/1.1 |
| 6,593,959 | B1 | 7/2003 | Kim et al. | |

(Continued)

FOREIGN PATENT DOCUMENTS

| | | |
|---|---|---|
| CN | 2509797 | 9/2002 |
| CN | 1412736 | 4/2003 |

(Continued)

*Primary Examiner* — Kwang-Su Yang
(74) *Attorney, Agent, or Firm* — McKenna Long & Aldridge LLP

(57) ABSTRACT

Provided are a display device and a method for driving the same. The display device includes: a plurality of display modules; a plurality of display module drivers for respectively driving the display modules; a data divider receiving data signals for displaying an image on the display device and separating the received data signals into output data signals corresponding to each respective display module driver; and a timing control signal generator for generating a timing control signal to be supplied commonly to the display module drivers.

7 Claims, 4 Drawing Sheets

(56) References Cited

U.S. PATENT DOCUMENTS

| | | | | |
|---|---|---|---|---|
| 6,867,759 | B1 * | 3/2005 | Baek et al. | 345/99 |
| 6,894,706 | B1 | 5/2005 | Ward et al. | |
| 7,456,836 | B2 | 11/2008 | Mamiya et al. | |
| 7,573,438 | B2 | 8/2009 | Nohara | |
| 7,868,862 | B2 | 1/2011 | Lee et al. | |
| 8,380,053 | B2 * | 2/2013 | Tran et al. | 386/329 |
| 2004/0061661 | A1 | 4/2004 | Kishita et al. | |
| 2004/0222959 | A1 | 11/2004 | Lin et al. | |
| 2005/0083294 | A1 | 4/2005 | Kim et al. | |
| 2005/0156934 | A1 | 7/2005 | Perego et al. | |
| 2005/0253833 | A1 * | 11/2005 | Teshirogi et al. | 345/204 |
| 2007/0043890 | A1 * | 2/2007 | Miller | 710/68 |
| 2007/0057959 | A1 * | 3/2007 | Cho et al. | 345/589 |

FOREIGN PATENT DOCUMENTS

| | | |
|---|---|---|
| CN | 1588187 | 3/2005 |
| JP | 2006-047932 | 2/2006 |
| KR | 10-2002-0002163 | 1/2002 |

* cited by examiner

DISPLAY DEVICE TO DRIVE A PLURALITY OF DISPLAY MODULES FOR DIVIDING DATA SIGNALS

This application is a continuation of U.S. application Ser. No. 12/003,775 filed Dec. 31, 2007, and claims the benefit of Korean Patent Application No. 10-2007-0035843, filed on Apr. 12, 2007, each of which are hereby incorporated by reference for all purposes as if fully set forth herein.

BACKGROUND OF THE INVENTION

1. Field of the Invention

The present invention relates to a display device, and more particularly, to a display device with a simplified driving circuit and a method for driving the same 2. Discussion of the Related Art With the advent of an information age, flat display devices for displaying information are being actively developed. Because flat display devices are light in weight and have slim profiles, they are rapidly replacing cathode ray tubes (CRTs). Flat display devices also have low power consumption, and can display full-color moving pictures.

Examples of the flat display devices include liquid crystal display (LCD) devices, plasma display devices, organic electro-luminescence display devices, and field emission display devices.

Recently, the demand for large-screen high-quality display devices has increased along with increases in the living standards of consumers, and accordingly, the development of equipment enabling mass-production technologies for large-screen LCD devices has increased.

There is a limitation on the size obtainable for a large-screen LCD device by increasing the size of a single LCD panel. At present, the maximum panel size is about 10 inches.

In order to solve the size limitation problem, a technique of implementing a large-sized screen by installing an optical system at a plurality of small-sized LCD panels has been proposed. However, this technique also causes a decrease in resolution.

Another technique is to develop a tiled LCD device that has a plurality of small-sized LCD panels joined together.

However, the tiled LCD device uses a plurality of image output systems for controlling a plurality of LCD panels.

Therefore, the related art tiled LCD device uses a complex driving circuit and the plurality of LCD panels is difficult to control.

SUMMARY OF THE INVENTION

Accordingly, the present invention is directed to a display device and a method for driving the same that substantially obviate one or more of the problems due to limitations and disadvantages of the related art.

An advantage of the present invention is to provide a display device with a simplified driving circuit and a method for driving the same.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display device includes: a plurality of display modules; a plurality of display module drivers for respectively driving the display modules; a data divider receiving data signals for displaying an image on the display device and separating the received data signals into output data signals corresponding to each respective display module driver; and a timing control signal generator for generating a timing control signal to be supplied commonly to the display module drivers.

In another aspect of the present invention, a method for driving a display device includes: dividing data signals for displaying an image on the display device; storing the divided data signals respectively in a plurality of memories; supplying the stored data signals respectively to display module drivers; generating control signals modulated in accordance with the resolutions of display modules to supply the modulated control signals to the display module drivers; and displaying data signals supplied from the respective display module drivers on the respective display modules according to control signals supplied from the respective display module drivers.

It is to be understood that both the foregoing general description and the following detailed description of the present invention are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to the embodiments of the present disclosure, examples of which are illustrated in the accompanying drawings.

Figure 1:
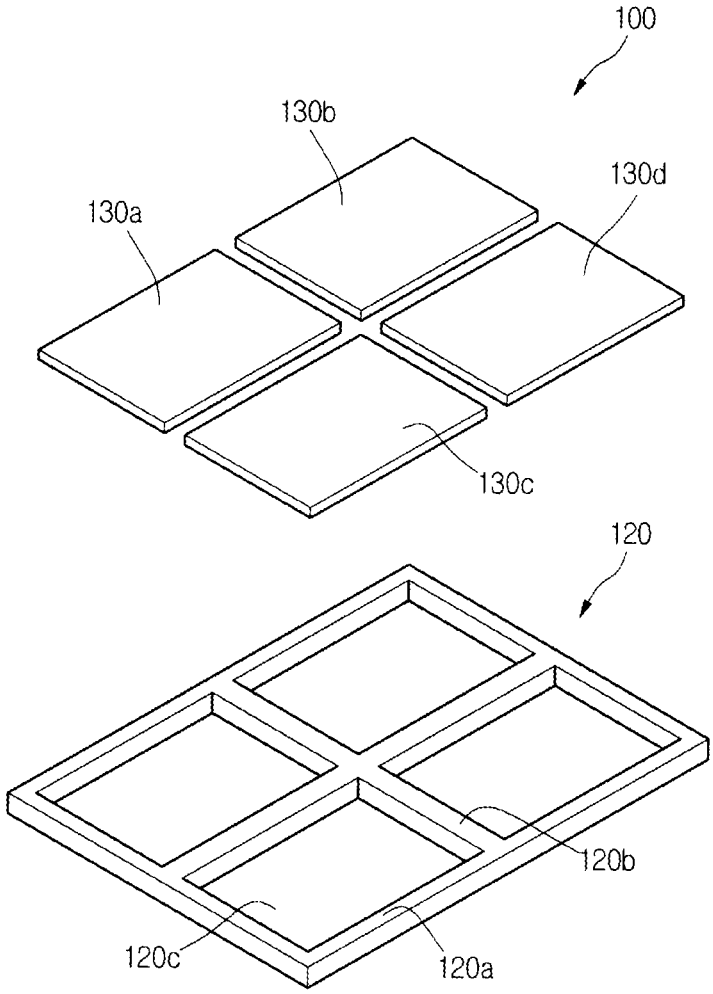
FIG. 1 is a perspective view of a tiled LCD device according to an embodiment of the present invention.
Figure 2:
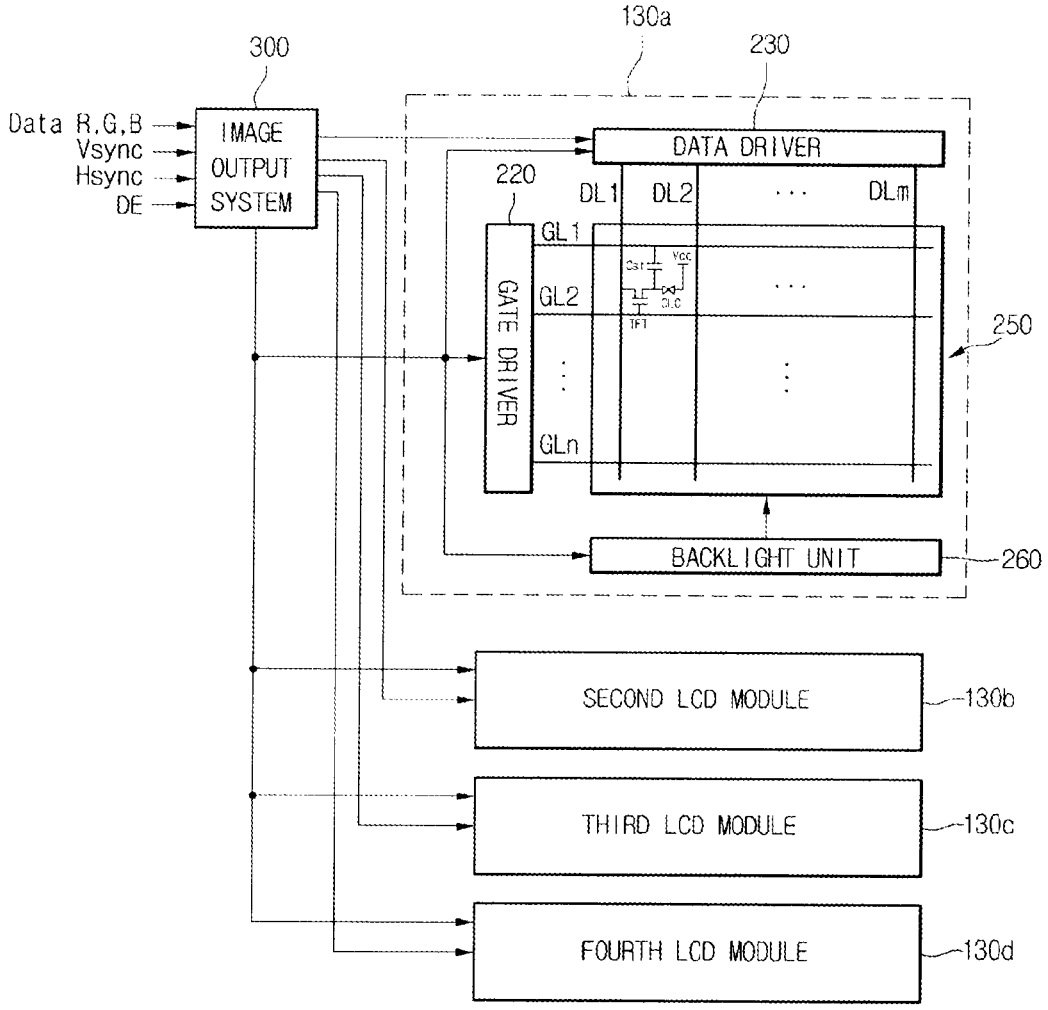
FIG. 2 is a block diagram of the tiled LCD device illustrated in FIG. 1.

FIG. 1 is a perspective view of a tiled LCD device according to an embodiment. FIG. 2 is a block diagram of the tiled LCD device illustrated in FIG. 1.

Referring to FIG. 1, a tiled LCD device 100 includes a plurality of LCD modules 130*a* to 130*d* and a frame 120 for joining the LCD modules 130*a* to 130*d*. Each of the LCD modules 130*a* to 130*d* includes a backlight unit and a LCD panel that are attached together. The frame 120 includes an outer wall frame 120*a* forming an outer wall and a barrier frame 120*b* to which the LCD modules 130*a* to 130*b* are attached. Each of the LCD modules 130*a* to 130*d* is fixed to the outer wall frame 120*a* and the barrier frame 120*b* while being placed in a space 120*c* partitioned by the outer wall frame 120*a* and the barrier frame 120*b*.

Referring to FIG. 2, the tiled LCD device includes an image output system 300 and a plurality of LCD modules 130*a* to 130*d*. The image output system 300 generates a control signal and outputs a data signal. The LCD modules

130*a* displays an image using the control signal and the data signal received from the image output system 300. The control signal includes a gate control signal and a data control signal.

The LCD modules 130*a* to 130*d* each have the same configuration, and thus the first LCD module 130*a* is used as an example in the following description.

The first LCD module 130*a* includes an LCD panel 250, a gate driver 220, and a data driver 230. The LCD panel 250 is configured to display an image, and the gate driver 220 and the data driver 230 are configured to drive the LCD panel 250.

A backlight unit 260 is provided at the rear of the LCD panel 250 to provide light to the LCD panel 250.

A plurality of gate lines GL1, GL2 . . . , GLn that cross a plurality of data lines DL1, DL2, . . . DLm are arranged in the LCD panel 250, and a thin-film transistor TFT serving as a switching device is disposed at each of the crossings between the gate lines and the data lines. A gate terminal of the thin-film transistor TFT is electrically connected to the corresponding gate line, a source terminal of the thin-film transistor TFT is electrically connected to the corresponding data line, and a drain terminal of the thin-film transistor TFT is electrically connected to a pixel electrode.

The thin-film transistor is turned on or off by a scan signal (i.e., a gate high voltage VGH or a gate low voltage VGL) that is supplied to the corresponding gate line.

When the thin-film transistor TFT is turned on, a data voltage of the corresponding data line is supplied to the pixel electrode via the source/drain terminals of the thin-film transistor TFT. The data voltage is sustained at the pixel electrode until a gate high voltage VGH is supplied in the next frame.

In response to a gate control signal from the image output system 300, the gate driver 220 supplies a gate high voltage VGH or a gate low voltage VGL sequentially to the gate lines GL1, GL2, . . . , GLn.

In response to a data control signal from the image output system 300, the data driver 230 supplies data voltages to the data lines DL1, DL2, . . . , DLm. The data driver 230 converts a red (R)/green (G)/blue (B) data signal received from the image output system 300 into an analog data voltage for supply to a data line.

Using a vertical control signal Vsync, a horizontal control signal Hsync, a data enable signal DE, and a data clock signal Delk, the image output system 300 generates a gate control signal GCS for controlling the gate driver 220 and a data control signal DCS for controlling the data driver 230.

The image output system 300 receives R/G/B data signals from an external source and supplies the data signals to the data driver 230 of each of the LCD modules 130*a* to 130*d*.

The image output system 300 supplies control signals and data signals to a plurality of LCD panel drivers for driving a plurality of LCD panels 250. The LCD panel driver for each LCD module includes the gate driver 220 and the data driver 230 illustrated in FIG. 2.

The image output system 300 stores the external R/G/B data signals in a plurality of memories in a distributed fashion, and supplies the stored R/G/B data signals to the data driver 230 of each of the LCD modules 130*a* to 130*d*. Additionally, using the vertical control signal Vsync, the horizontal control signal Hsync, the data enable signal DE, and the data clock signal Delk, the image output system 300 generates a common control signal to be supplied commonly to the LCD modules 130*a* to 130*d* and that is supplied together with the R/G/B data signals.

Although in the above description, the image output system 300 supplies the control signals for controlling the gate driver 220 and the data driver 230 of the LCD modules 130*a* to 130*d*, the present invention is not limited to this particular arrangement. For example, separate timing controllers may alternatively be used to generate the control signals for controlling the gate driver 220 and the data driver 230.

Further, although a tiled LCD device has been exemplified, the present invention is not limited to operation with tiled LCD devices. For example, the present invention may also be applied to a tiled plasma display device, a tiled organic electro-luminescence display device, or a tiled field emission display device.

The above-described tiled LCD device can control the display operations of a plurality of LCD modules 130*a* to 130*d* using one image output system 300, thereby making it possible to simplify the configuration of the driving circuit and to thereby reduce costs.

Figure 3:
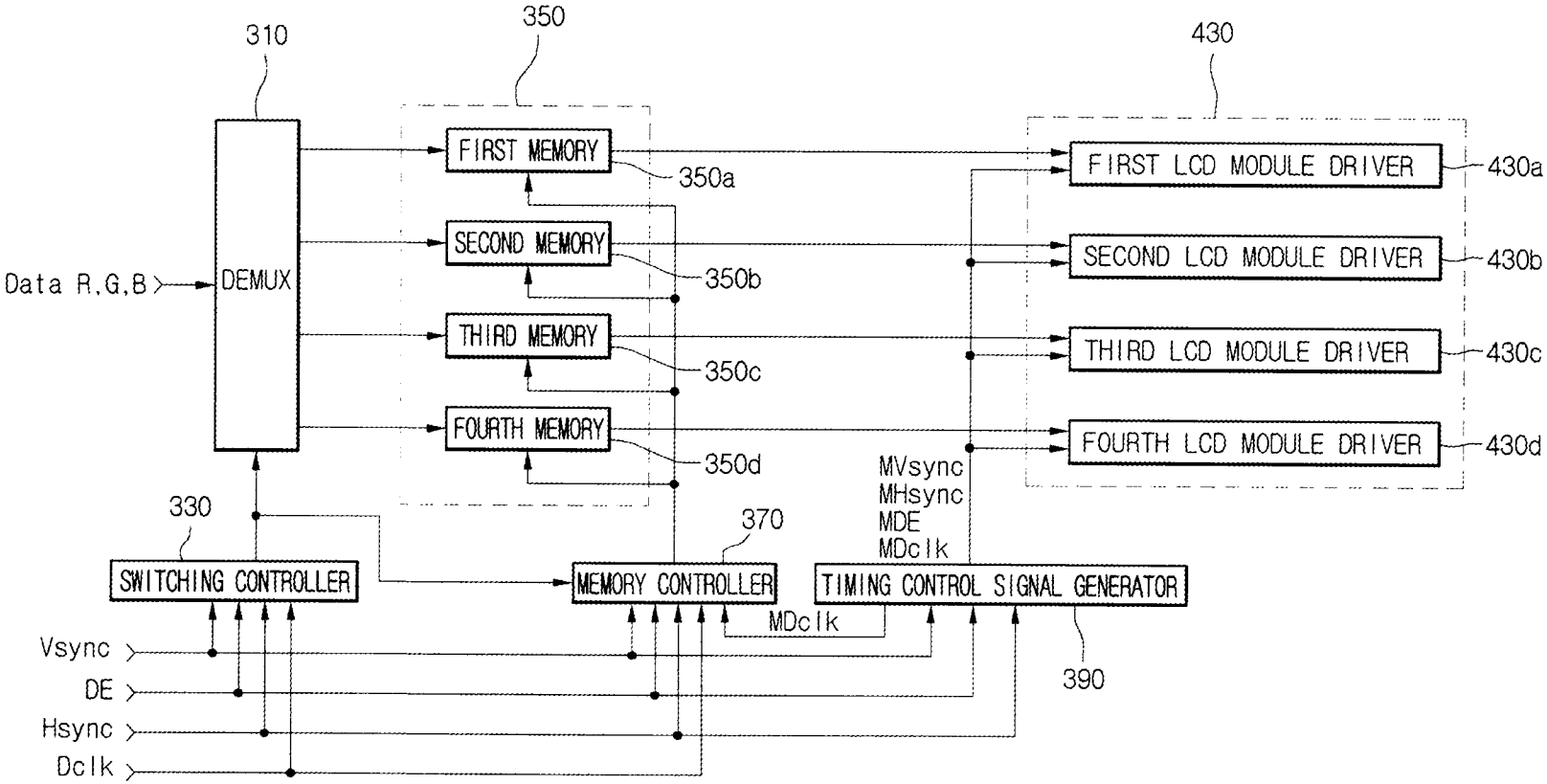
FIG. 3 is a block diagram of an image output system illustrated in FIG. 2.

FIG. 3 is a block diagram of the image output system illustrated in FIG. 2.

Referring to FIG. 3, the image output system 300 includes a demultiplexer (DEMUX) 310 and a memory unit 350. The demultiplexer 310 switches external data signals so that the external data signals are output through a plurality of output lines selected at regular intervals. The memory unit 350 is configured to store the data signals output from the demultiplexer 310.

The image output system 300 includes a switching controller 330, a memory controller 370, and a timing control signal generator 390. The switching controller 330 controls the demultiplexer 310, and the memory controller 370 controls the memory unit 350. The timing control signal generator 390 generates a timing control signal for controlling first to fourth LCD module drivers 430*a* to 430*d*.

The switching controller 330 controls the demultiplexer 310 using the vertical control signal Vsync, the horizontal control signal Hsync, the data enable signal DE, and the data clock signal Dclk that are received from a source external to the display device.

The switching controller 330 and demultiplexer 310 constitute a data divider. Using the vertical control signal Vsync, the horizontal control signal Hsync, and the data enable signal DE, the data divider can divide the R/G/B data signals received by the data divider into data signals for the first and second LCD module drivers 430*a* and 430*b* and for the third and fourth LCD module drivers 430*c* and 430*d*.

Using the horizontal control signal Hsync, the data enable signal DE, and the data clock signal Dclk, the data divider can divide the R/G/B data signals received by the data divider into data signals for the first and third LCD module drivers 430*a* and 430*c* and data signals for the second and fourth LCD module drivers 430*b* and 430*d*.

The R/G/B data signals divided by the data divider are received by the first to fourth memories 350*a* to 350*d* of the memory unit 350. The memory unit 350 may be implemented using an electrically erasable programmable read-only memory (EEPROM).

The memory unit 350 may be implemented using a dual-port memory that can store a 2-frame data signal and can perform a writing/reading operation including concurrently reading and writing data signals.

The first to fourth memories 350*a* to 350*d* respectively store image data of the LCD panels of LCD modules 430 in the tiled LCD device.

The memory controller 370 controls reading/writing operations for data signals stored in the memory unit 350.

In the writing operation, using the period of the data clock signal Dclk, the memory controller 370 writes external data signals in the memory unit 350 for the respective pixels of the LCD panels of the LCD modules 430*a* to 430*d*.

In the reading operation, the memory controller 370 performs a control operation of reading pixel data line by line and outputting the 1-line pixel data at a frequency corresponding to ½ of an input data clock (i.e., a double period). The frequency corresponding to ½ of the data clock is implemented using a modulation data clock signal MDclk generated by the timing control signal generator 390.

Herein, the R/G/B data signals stored in the first to fourth memories 350*a* to 350*d* are read out simultaneously. That is, using a switching control signal from the switching controller 330, the memory controller 370 reads 1-line R/G/B data signals of the respective ones of the LCD modules 430 and outputs the read data to the first to fourth LCD module drivers 430*a* to 430*d* simultaneously.

The R/G/B data signals stored in the first to fourth memories 350*a* to 350*d* are respectively input into the first to fourth LCD module drivers 430*a* to 430*d* by the memory controller 370. More particularly, the R/G/B data signals stored in the first to fourth memories 350*a* to 350*d* are respectively input into the corresponding data drivers 230 included in the first to fourth LCD module drivers 430*a* to 430*d*.

Using the vertical control signal Vsync, the horizontal control signal Hsync, the data enable signal DE, and the data clock signal Dclk, the timing control signal generator 390 generates modulated control signals MVsync, MHsync, MDE and MDclk, with the modulated control signals being generated in accordance with the resolutions of the LCD modules 430.

Using the modulated control signals MVsync, MVsync, MDE and MDclk, the timing control signal generator 390 generates gate control signals GCSs (e.g., GSP, GSC, GOE, etc.) and data control signals DCSs (e.g., SSP, SSC, SOE, POL, REV, etc.) that are to be supplied to the first to fourth LCD module drivers 430*a* to 430*d*.

The timing control signal generator 390 outputs the gate control signals GCSs (e.g., GSP, GSC, GOE, etc.) and the data control signals DCSs (e.g., SSP, SSC, SOE, POL, REV, etc.) to the first to fourth LCD module drivers 430*a* to 430*d*.

Among the control signals from the timing control signal generator 390, the modulation data clock signal MDclk is input into the memory controller 370 for the reading operation of the memory controller 370.

The modulated control signals GCS and DCS generated in accordance with the resolutions of the LCD modules 430 are input simultaneously with the input of the R/G/B data signals stored in the first to fourth memories 350*a* to 350*d* into the first to fourth LCD module drivers 430*a* to 430*d*.

The image output system shown in FIG. 3 divides the external R/G/B data signals to be respectively input into the LCD modules 430. When the divided R/G/B data signals are input into the LCD modules 430, the modulated control signals GCS and DCS in accordance with the resolutions of the LCD modules 430 are simultaneously input. Accordingly, by utilizing embodiments of the present invention the structure of the driving circuit may be simplified in comparison with the related art tiled LCD device that uses as many image output systems as the number of LCD modules.

Additionally, costs may be reduced by driving a plurality of LCD modules 430 using a single image output system.

Although in the above description, the tiled LCD device has four LCD modules 430, the present invention is not limited to being practiced with a particular number of LCD modules. That is, the number of the LCD modules 430 may vary and the number of the memory units 350 may vary accordingly.

Further, although a tiled LCD device has been exemplified, the present invention is not limited to driving tiled LCD devices. For example, the present invention can also be applied to a tiled plasma display device, a tiled organic electro-luminescence display device, or a tiled field emission display device.

Figure 4:
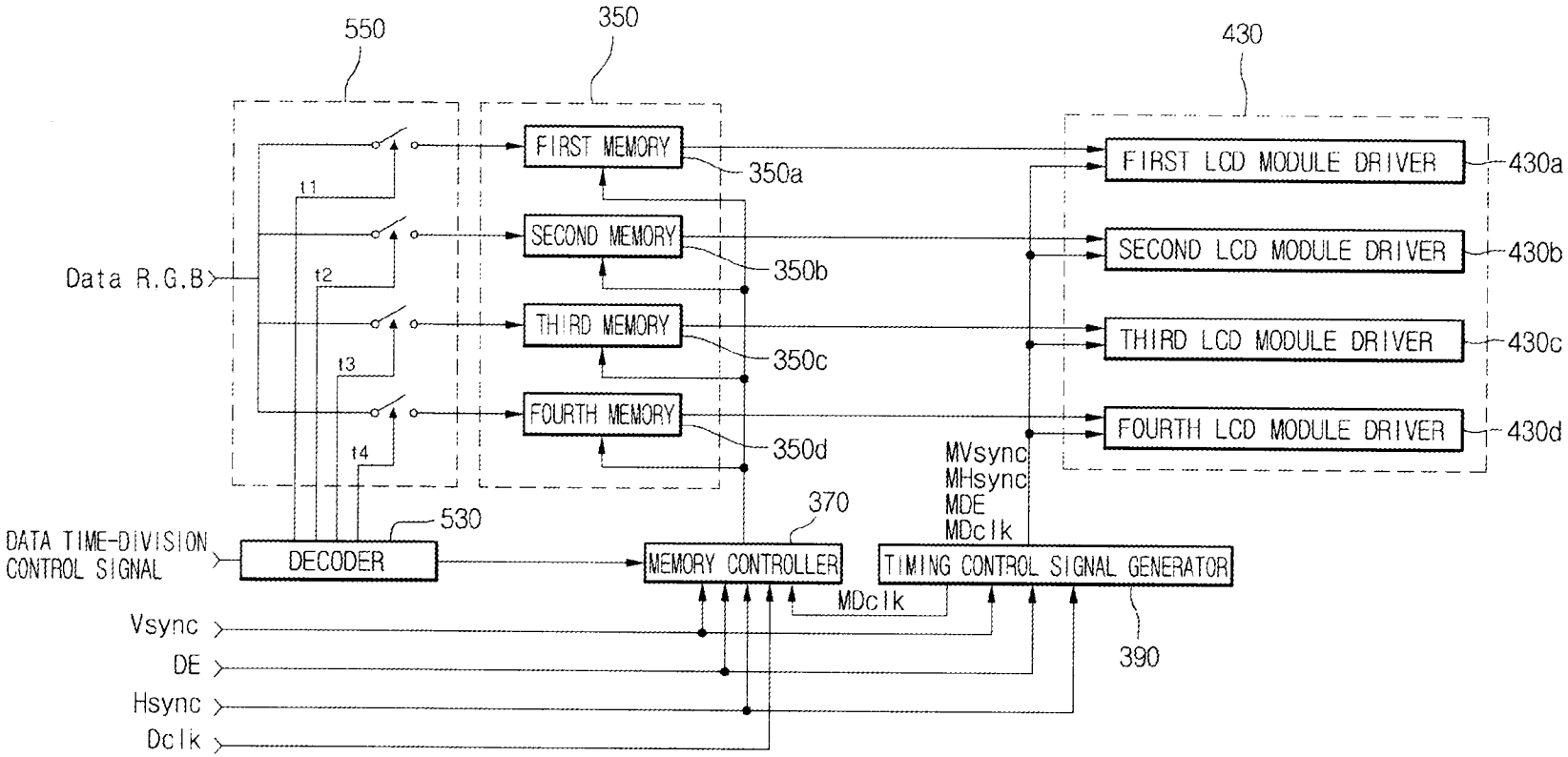
FIG. 4 is a block diagram of an image output system according to another embodiment of the present invention.

FIG. 4 is a block diagram of the image output system according to another embodiment of the invention.

Except that a switching unit 550 and a decoder 530 are used as a data divider, the image output system of FIG. 4 has the same elements as shown in FIG. 3. In this context, like elements are denoted by like reference numerals, and a detailed description of the like elements will be omitted for conciseness.

Referring to FIG. 4, in response to a control signal from the decoder 530, the switching unit 550 is turns on or off such that the external R/G/B data signals are respectively stored in the first to fourth memories 350*a* to 350*d*. Herein, the R/G/B data signals are video signals received from a source external to the display device and that correspond respectively to the LCD modules 430.

The decoder 530 controls the switching unit 550 such that the external data signals are distributed in units of predetermined times t1, t2, t3 and t4 in response to an externally generated data time-division control signal. The predetermined times t1, t2, t3 and t4 are determined by the data time-division control signals and are preset by an external system (not illustrated).

The switching unit 550 and the decoder 530 constitute a data divider. The data divider divides the external R/G/B data signals at predetermined time intervals (t1, t2, t3 and t4) corresponding to the LCD modules 430.

The FIG. 4 image output system divides, stores, and outputs the data signals corresponding to the LCD modules 430 at the predetermined time intervals (t1, t2, t3 and t4), thereby making it possible to drive a plurality of LCD modules 430 using one image output system. Accordingly, the present invention can simplify the structure of the driving circuit in comparison with the related art tiled LCD device that has as many image output systems as the number of LCD modules.

In addition, costs can be may be reduced because a plurality of LCD modules 430 may be driven using a single image output system.

As described above, the tiled display device of the present invention can drive a plurality of display modules using one image output system that distributes and transfers data signals that are input frame by frame, thereby making it possible to simplify the structure of the display device driving circuit.

Further, the tiled display device of the present invention can drive a plurality of display modules using one image output system, thereby making it possible to reduce costs in comparison with the related art tiled display device.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device to drive a plurality of display modules for dividing data signals comprising:

the plurality of display modules for displaying an image;

a plurality of display module drivers for respectively driving the display modules;

a data divider receiving data signals for displaying an image on the display device and separating the received data signals into output data signals corresponding to each respective display module driver; and a timing control signal generator for generating a timing control signal to be supplied commonly to the display module drivers, wherein the timing control signal generator modulates a vertical control signal, a horizontal control signal, a data enable signal and a data clock signal, wherein the data divider comprises a memory controller for controlling reading and writing operations of the memories, a switching unit for turning on or off such that the data signals are respectively stored in the memories and a decoder for controlling the switching unit such that the data signals are distributed in units of predetermined times in response to an externally generated data time-division control signal, wherein in the writing operation, the memory controller writes external data signals in the memories for the respective pixels of the plurality of display modules using the period of the data clock signal, wherein in the reading operation, the memory controller performs a control operation of reading pixel data line by line and outputting a 1-line pixel data at a frequency corresponding to ½ of an input data clock signal, and wherein the timing control signal generator generates the timing control signal to be supplied directly and commonly only to the plurality of display module drivers and the memory controller.

2. The display device according to claim 1, wherein the predetermined times are determined by the data time-division control signals and are preset by an external system.

3. The display device according to claim 1, wherein the memory controller controls the reading and writing operations of the memories using the vertical control signal, the horizontal control signal, the data enable signal, the data clock signal, and the modulation data clock signal generated by the timing control signal generator.

4. The display device according to claim 1, wherein each of the memories includes a dual-port memory that stores data signals for two display frames.

5. The display device according to claim 1, wherein the timing control signal generator generates control signals modulated in accordance with the resolutions of the display modules by using the vertical control signal, the horizontal control signal, the data enable signal, and the data clock signal.

6. The display device according to claim 1, wherein the data divider divides the received data signals at predetermined time intervals corresponding to the respective display modules.

7. The display device according to claim 1, wherein the data signals stored in the plurality of memories are read out simultaneously and are respectively input into the corresponding display module drivers.

* * * * *